United States Patent [19]

Grenier et al.

[11] Patent Number: 4,977,746

[45] Date of Patent: Dec. 18, 1990

[54] PROCESS AND PLANT FOR SEPARATING AIR AND PRODUCING ULTRA-PURE OXYGEN

[75] Inventors: Maurice Grenier, Paris; Philippe Mazieres, Montfermeil, both of France

[73] Assignee: l'Air Liquide, Societe Anonyme pour l'Etude et l'Exploitation des Procedes Georges Claude, Paris, France

[21] Appl. No.: 467,768

[22] Filed: Jan. 19, 1990

[30] Foreign Application Priority Data

Jan. 20, 1989 [FR] France ..... 89 00670

[51] Int. Cl.[5] ..... F25J 3/04

[52] U.S. Cl. ..... 62/22; 62/24; 62/31; 62/27; 62/44

[58] Field of Search ..... 62/22, 24, 27, 31, 42, 62/44

[56] References Cited

U.S. PATENT DOCUMENTS

| | | | |
|---|---|---|---|
| 4,575,388 | 3/1986 | Okada | 62/22 |
| 4,615,716 | 10/1986 | Cormier et al. | 62/24 |
| 4,715,874 | 12/1987 | Erickson | 62/22 |
| 4,756,731 | 7/1988 | Erickson | 62/22 |
| 4,762,542 | 8/1988 | Mishkovsky et al. | 62/22 |
| 4,769,055 | 9/1988 | Erickson | 62/22 |
| 4,824,453 | 4/1989 | Rottmann et al. | 62/22 |

FOREIGN PATENT DOCUMENTS 0299364 1/1989 European Pat. Off. .

*Primary Examiner*—Ronald C. Capossela
*Attorney, Agent, or Firm*—Young & Thompson

[57] ABSTRACT

Oxygen from the bottom of a low pressure column (4) is purified from hydrocarbons in a first auxiliary column (12), and the vapor at the top of this column is distilled in a second auxiliary column (17) heated at the base thereof with air at medium pressure. Ultra-pure oxygen is produced at the bottom of the second auxiliary column. Application in the production of ultra-pure oxygen for the electronic industry.

16 Claims, 2 Drawing Sheets

W
11

8
7
16
23
22
24
20
1
15
18
4
n
12
17
13
n+n1
GO2
9
14
-5-
LL
GN2
10
19
25
2
ultra-pure
liquid O2
3
21
6
21A
AIR
RL

PROCESS AND PLANT FOR SEPARATING AIR AND PRODUCING ULTRA-PURE OXYGEN

The present invention relates to a process and plant for producing ultra-pure oxygen with a principal double-column air distillation apparatus comprising a medium pressure column and a low pressure column.

"Ultra-pure oxygen" is intended to mean oxygen substantially devoid of methane (and therefore hydrocabons) and argon, for example containing less than 0.1 ppm of hydrocarbons and less than 10 ppm of argon, these contents being determined beforehand and variable with the applications. The ultra-pure oxygen is in particular intended for the electronic industries.

An object of the invention is to produce ultra-pure oxygen at the cost of a cheap modification of the principal distillation apparatus and, above all, with no additional expenditure of energy.

The process according to the invention therefore comprises:

sending to the bottom of a first auxiliary column a first gas produced in the lower part of the low pressure column, and returning to the low pressure column liquid produced in the bottom of the first auxiliary column;

distilling in a second auxiliary column a fluid produced at the top of the first auxiliary column, the ultra-pure oxygen being produced in the bottom of the second auxiliary column, and heating the bottom of the second auxiliary column by condensing therein a heating gas available at the medium pressure at the level of the lower or intermediate part of the medium pressure column, and returning the condensate to the principal air distillation apparatus.

The heating gas may be in particular compressed air taken from the supply of the medium pressure column.

The invention also provides a plant for separating air and producing ultra-pure oxygen for carrying out the process defined hereinbefore. This plant, of the type comprising a principal double column air distillation apparatus itself including a medium pressure column and a low pressure column, further comprises:

a first auxiliary column whose bottom is connected to the lower part of the low pressure column through a first gas pipe and through a second liquid pipe;

a second auxiliary column connected through a third pipe to the top of the first auxiliary column;

an indirect heat exchanger disposed in the bottom of the second auxiliary column;

means for taking off at the level of the lower or intermediate part of the medium pressure column a heating gas at the medium pressure and introducing it into the heat exchanger, and means for returning to the principal air distillation apparatus the condensate issuing from the heat exchanger.

Some embodiments of the invention will now be described with reference to the accompanying drawings, in which.

Figure 1:
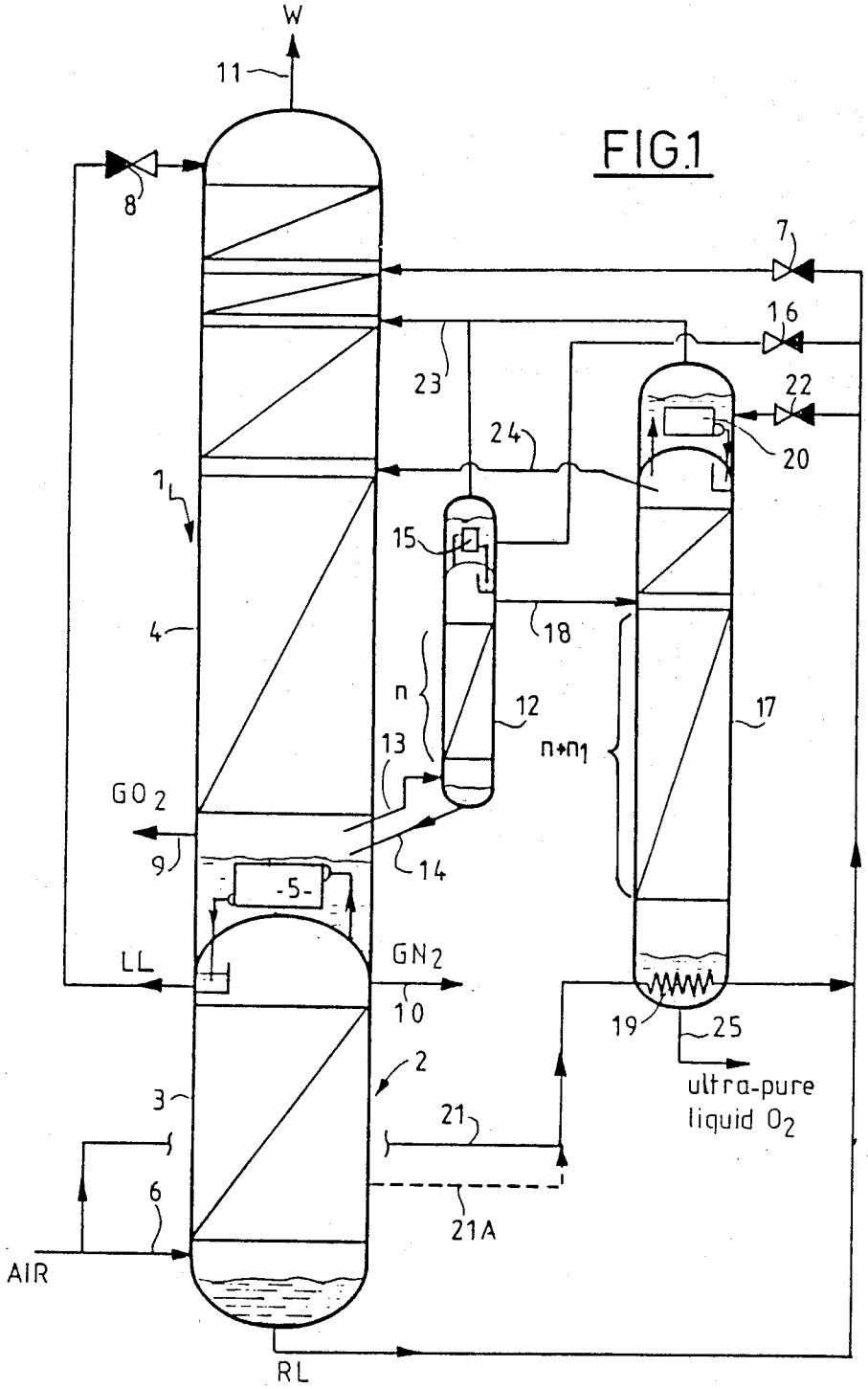
FIG. 1 is a diagrammatic view of a plant according to the invention.

The plant shown in FIG. 1 is adapted to separate air into its constituents for the purpose of producing: gaseous nitrogen under pressure; gaseous oxygen of about 99.5% purity; and ultra-pure oxygen having a predetermined maximum content of methane and argon, for example less than 0.1 ppm of methane and less than 10 ppm of argon. The production of ultra-pure oxygen corresponds to a small fraction, preferably between 5 and 10%, of the oxygen production of the plant.

The plant comprises a principal air distillation apparatus 1 itself including a double distillation column 2. The double column comprises a medium pressure column 3 surmounted by a low pressure column 4. A vaporizer-condenser 5 puts into indirect thermal exchange relation the nitrogen of the top of the column 3 and the liquid (oxygen of about 99.5% purity) of the bottom of the column 4.

The air to be treated, purified and cooled at its dew point, is in major part introduced at the medium pressure, namely about 6 bars (absolute), at the base of the column 3 through a pipe 6. Its condensation produces a "rich liquid" RL a part of which is expanded in an expansion valve 7 and introduced at an intermediate level of the column 4, which operates at the low pressure, namely slightly above atmospheric pressure. "Poor liquid" LL, essentially constituted by nitrogen, is taken off at the top of the column 3 then, after expansion in an expansion valve 8, introduced at the top of the column 4. The double column 2 further comprises a pipe 9 for producing gaseous oxygen of 99.5% purity at the bottom of the column 4, a pipe for producing gaseous nitrogen at 6 bars at the top of the column 3, and a pipe 11 for discharging a residual gas W (impure nitrogen) leading from the top of the column 4.

A first auxiliary column 12 having a small number n of theoretical plates, with n between 3 and 8, is connected to the bottom of the column 4 through a pipe 13 for supplying gas and through a pipe 14 for returning liquid, and provided with a top condenser 15. The latter is fed with a part of the rich liquid RL expanded in an expansion valve 16.

A second auxiliary column 17 is fed at an intermediate place, through a pipe 18, with the vapour of the top of the column 12. It comprises n+n1 theoretical plates below the pipe 18. Its bottom comprises a vaporizer 19 and its top a condenser 20. The vaporizer is heated with air at 6 bars taken from the pipe 6 through a pipe 21, and the condenser 20 is cooled with the remainder of the rich liquid RL expanded in an expansion valve 22. The rich liquid vaporized in the condensers 15 and 20 is returned to the column 4 through a common pipe 23. The liquefied air issuing from the vaporizer 19 may be returned at the corresponding level to the column 4 or, as shown, reunited with the rich liquid taken off from the bottom of the column 4, bearing in mind that its flow is low relative to that of this rich liquid.

A pipe 24 connects the top of the column 17 to an intermediate point of the column 4.

In operation, the oxygen conducted through the pipe 13 contains argon and methane as impurities. The methane is separated from the oxygen and the argon in the column 12 having n theoretical plates all the more completely as the number n increases. Calculation shows that a number n less than or equal to 8 is sufficient for the usual applications of ultra-pure oxygen.

Thus, it is a mixture formed substantially solely by oxygen and argon which enters the column 17 through the conduit 18. Ultra-pure liquid oxygen having the desired maximum content of argon and methane is taken off through a pipe 25 at the bottom of the column 17.

Moreover, bearing in mind the reflux rates required in the column 17 and the flows to be employed, it is necessary to concentrate in argon the vapour returned to the principal distillation apparatus through the conduit 24. This is why the column 17 comprises above the feed thereto a certain number of additional plates, the reflux being ensured throughout the column by the top condenser 20.

The invention is applicable in the same way to principal air distillation apparatus producing oxygen having a purity of lower than 99.5%, for example 95 or 97%. Indeed, the gas taken off through the conduit 13 then contains nitrogen which is easily separated from the oxygen in the auxiliary column 17. Furthermore, as indicated by the dotted line 21A in FIG. 1, there may be employed instead of air, for heating the vaporizer 19, a gas poorer in oxygen taken from the lower or intermediate part of the column 3, which is to say from a level no higher than an intermediate part of the column 3. The oxygen content of the heating gas must however remain sufficient to ensure, by the condensation of this gas, the vaporization of the ultra-pure oxygen. Indeed, this vaporization occurs at a pressure higher than the pressure of the bottom of the column 4 owing to the presence of n1 supplementary plates of the column 17.

Figure 2:
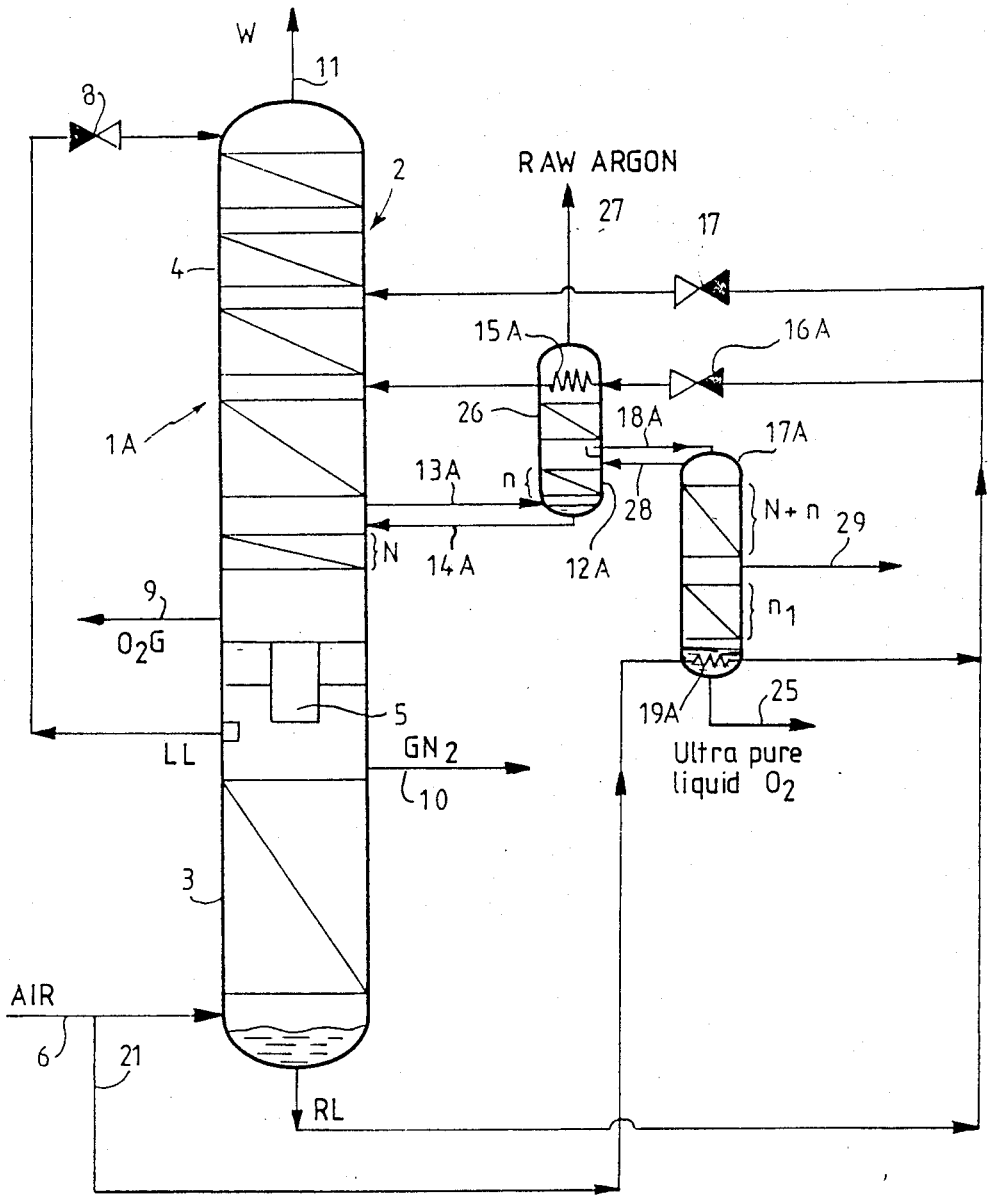
FIG. 2 is a diagrammatic view of a variant of this plant.

The variant shown in FIG. 2 shows how the invention may be applied to a principal air distillation apparatus 1A provided with an oxygen-argon separation column 26. The same reference numerals, possibly followed by the suffix A, will be employed for designating the elements corresponding to those of FIG. 1.

For producing argon, a pipe 13A, termed "argon take-off pipe" leads from an intermediate place of the column 4, N theoretical plates above the bottom. This pipe leads to the bottom of the column 26 and conducts a gas essentially constituted by oxygen and argon, and a return pipe 14A leads from the lowest point of the column 26 and is connected to the column 4 roughly at the level of the argon take-off pipe 13A. The column 26 is provided with a top condenser 15A fed with the part of the rich liquid RL not expanded in the valve 7, this liquid being expanded in an expansion valve 16A. The vaporized rich liquid issuing from the condenser 15A is returned to the column 5 a little below the rich liquid issuing from the valve 7. The raw argon produced at the top of the column 26 is discharged through a pipe 27.

The principal distillation apparatus 1A is modified in the following manner for producing ultra-pure oxygen.

At a level corresponding to a small number n of theoretical plates above the bottom of the column 26 (n between 3 and 8), liquid is taken off through a pipe 18A and fed to the top of an auxiliary column 17A. A pipe 28 returns the vapour of the top of this column to the same level of the column 26. The lower part of the column 26 defined below the pipes 18A and 28 will be designated 12A, this part 12A corresponding to the first auxiliary column 12 of FIG. 1, as will be clear hereinafter.

A vaporizer 19A is disposed in the bottom of the column 17A. This vaporizer is heated as before with air at 6 bars conducted through the pipe 21 and reunited with the rich liquid RL after condensation.

In operation, the oxygen-argon gaseous mixture conducted through the pipe 13A contains methane as impurity. The methane is separated from the oxygen and the argon in the lower section 12A having n theoretical plates of the column 26 all the more completely as the number n increases. Calculation shows that a number n smaller than or equal to 8 is sufficient for the usual applications of ultra-pure oxygen.

Thus, it is the mixture substantially solely constituted by oxygen and argon which enters the column 17A. By choosing the reflux rate at the top of the column 17A roughly equal to that of the bottom of the column 4, there is found at the level of the pipe 29 the content of 99.5% oxygen produced in the bottom of the column 4, and the column 17A has n1 theoretical plates below this pipe, which provides in the bottom ultra-pure liquid oxygen having the desired maximum content of argon. This ultra-pure oxygen is taken off through the pipe 25. As a numerical example, N may be chosen to be on the order of 30 to 40 and n1 on the order of 15 to 30.

Note that, as shown in FIG. 2, a pipe 29 for taking off liquid oxygen of about 99.5% purity may, as shown, lead from an intermediate place of the column 17A located at substantially N+n theoretical plates below the top of this column 17A. This oxygen is substantially devoid of hydrocarbons and may consequently be employed for certain applications in which hydrocarbons are undesirable, for example in the medical field.

What is claimed is:

1. Process for producing ultra-pure oxygen by employing a principal double column air distillation apparatus comprising a medium pressure column and a low pressure column, said process further comprising:

employing a first auxiliary column, sending to the bottom of the first auxiliary column a first gas produced in a lower part of the low pressure column, and returning to the low pressure column liquid produced at the bottom of the first auxiliary column;

employing a second auxiliary column, distilling in the second auxiliary column a fluid produced at the top of the first auxiliary column, the ultra-pure oxygen being produced at the bottom of the second auxiliary column, and heating the bottom of the second auxiliary column by condensing therein a heating gas available at the medium pressure at a level selected from a group consisting of the level of a lower part and the level of an intermediate part of the medium pressure column, and returning the condensate to the principal air distillation apparatus.

2. Process according to claim 1, wherein the first auxiliary column comprises a top condenser, said process comprising taking off said first gas at the bottom of the low pressure column.

3. Process according to claim 2, wherein the second auxiliary column comprises a top condenser, said process comprising feeding vapour from the top of the first auxiliary column to an intermediate point of the second auxiliary column, and returning the vapour of the top of the second auxiliary column to the low pressure column.

4. Process according to claim 1, wherein the first auxiliary column is constituted by a lower part of an oxygen-argon separation column which is associated with said double column and is part of the principal distillation apparatus, said process comprising drawing off said first gas at an argon take-off of the low pressure column.

5. Process according to claim 4, comprising feeding the top of the second auxiliary column with liquid taken off from the top of said lower part of the oxygen-argon separation column, and returning the vapour of the top of said second auxiliary column to substantially the same level of the oxygen-argon separation column.

6. Process according to claim 1, wherein the heating gas is constituted by compressed air taken from the supply of the medium pressure column.

7. Process according to claim 6, comprising adding the air condensed at the bottom of the second auxiliary column to rich liquid produced at the bottom of the medium pressure column.

8. Process according to claim 1, comprising taking off liquid oxygen substantially devoid of hydrocarbons at an intermediate level of the second auxiliary column.

9. Plant for separating air and producing ultra-pure oxygen, comprising a principal double column air distillation apparatus which includes a medium pressure column and a low pressure column, said plant further comprising:

a first auxiliary column having a bottom, a first gas pipe and a second liquid pipe connecting said bottom to the lower part of the low pressure column;

a second auxiliary column, a third pipe connecting the second auxiliary column to the top of the first auxiliary column;

an indirect heat exchanger disposed at the bottom of the second auxiliary column;

means for taking off, at a level no higher than the level of an intermediate part of the medium pressure column, a heating gas at the medium pressure and introducing it into the heat exchanger, and means for returning to the principal air distillation apparatus the condensate coming from the heat exchanger.

10. Plant according to claim 9, wherein the first auxiliary column comprises a top condenser and said first pipe is connected to the bottom of the low pressure column.

11. Plant according to claim 10, wherein the second auxiliary column comprises a top condenser and means are provided for feeding vapour at the top of the first auxiliary column to the second auxiliary column at an intermediate point of the second auxiliary column, and means for returning the vapour at the top of the second auxiliary column to the low pressure column.

12. Plant according to claim 9, wherein the first auxiliary column is constituted by a lower part of an oxygen-argon separation column which is associated with said double column and is part of said principal distillation apparatus, said first pipe constituting an argon take-off of the low pressure column.

13. Plant according to claim 12, comprising means for feeding the second auxiliary column with liquid taken off from the top of said lower part of the oxygen-argon separation column, and means for returning the vapour at the top of the second auxiliary column substantially to the same level of the oxygen-argon separation column.

14. Plant according to claim 9, wherein the heating gas is constituted by compressed air taken from the supply of the medium pressure column.

15. Plant according to claim 14, comprising means for adding the air condensed in the heat exchanger to the rich liquid produced at the bottom of the medium pressure column.

16. Plant according to claim 9, comprising a pipe for taking off oxygen substantially devoid of hydrocarbons connected to the second auxiliary column at an intermediate level of the second auxiliary column.

* * * * *